US005918435A

United States Patent [19]

McGowen

[11] Patent Number: 5,918,435

[45] Date of Patent: Jul. 6, 1999

[54] THREE DIMENSIONAL BORDER

[75] Inventor: Janette M. McGowen, 825 N. First St., Mascoutah, Ill. 62258

[73] Assignees: Sam H. McGowen; Janette M. McGowen, both of Mascoutah, Ill.

[21] Appl. No.: 09/044,266

[22] Filed: Mar. 19, 1998

[51] Int. Cl.[6] ..... E04F 13/08

[52] U.S. Cl. ..... 52/311.1; 52/314; 52/287.1; 52/288.1; 52/730.1

[58] Field of Search ..... 52/716.8, 717.04, 52/716.1, 311.1, 312, 287.1, 288.1, 33, 730.1, 314; 256/1

[56] References Cited

U.S. PATENT DOCUMENTS

| | | | |
|---|---|---|---|
| 435,845 | 9/1890 | Marston | 52/287.1 |
| 2,329,561 | 9/1943 | Shuttleworth . | |
| 3,193,434 | 7/1965 | Weiss | 52/311.1 |
| 3,485,002 | 12/1969 | Baker | 52/314 |
| 3,611,660 | 10/1971 | Costello | 52/314 |
| 3,683,994 | 8/1972 | Eichenlaub . | |
| 4,018,260 | 4/1977 | Baslow . | |
| 4,201,359 | 5/1980 | Baslow | 52/716.1 |
| 4,341,252 | 7/1982 | Schenk . | |
| 4,696,136 | 9/1987 | Grewe . | |
| 4,920,714 | 5/1990 | Sease | 52/716.1 |
| 4,922,600 | 5/1990 | Peters . | |
| 5,033,525 | 7/1991 | Paeselt . | |
| 5,088,252 | 2/1992 | Antekeier | 52/287.1 |
| 5,152,331 | 10/1992 | Barone . | |
| 5,159,965 | 11/1992 | Roy et al. . | |
| 5,275,224 | 1/1994 | Morris . | |
| 5,345,990 | 9/1994 | Potts | 160/38 |
| 5,496,609 | 3/1996 | Michelstein | 52/287.1 X |
| 5,555,687 | 9/1996 | Logan et al. | 52/287.1 |
| 5,665,190 | 9/1997 | Sanz | 52/311.1 |
| 5,743,064 | 4/1998 | Bennett | 52/716.1 |

*Primary Examiner*—Christopher Todd Kent
*Assistant Examiner*—Phi Dieu Tran A
*Attorney, Agent, or Firm*—Grace J. Fishel

[57] ABSTRACT

A three dimensional border for providing a decorative appearance as a crown molding or chair rail that can be installed and removed without damaging the wall or the border. The border has an elongated panel, preferably made of styrofoam, with a front face and a rear face. A form is attached to the front face of the panel with a surface upon a which a decorative treatment can be applied. The rear face is attached to the wall by nails or hooks set in the wall forming a recess in the rear face of the panel as the border is pressed against the wall.

9 Claims, 4 Drawing Sheets

42
10
62A
62
4
62B
62C
68
46B
12
16
24
66
60
20
14
46C
4

10
42
62A
64
46A
62B
12
46B
62C
46C
66
60

10'
42
6
70
72
10
62
18
64
46A
12
74
46C
66
20
14
46B
6

42
10
62
64

46A
12
46B
74
46C
66

THREE DIMENSIONAL BORDER

BACKGROUND OF THE INVENTION

1. Field of the Invention

The present invention relates to a custom-made, lightweight border used as a three dimensional decorating alternative to a flat wallpaper border.

2. Brief Description of the Prior Art

Wallpaper borders are used as crown moldings and as chair rails because they do not require a carpenter to install. Many homeowners, however, do not want a paper border pasted to the walls in their home because the wall may be damaged when the border is removed. Most walls are made of drywall consisting of a layer of gypsum sandwiched between thin sheets of paper. If the border tears the drywall paper as the border is removed, the wall must be patched before it can be painted or repapered, possibly requiring the services of a drywall specialist. It is for this reason that owners of rental homes and apartments and managers of college dorms usually will not allow a renter to hang wallpaper.

Wallpaper borders have a two-dimensional, flat appearance, and lack the warmth associated with fabric hangings. A fabric border having a three dimensional effect would be a great success if the border was easy to install and could be replaced without damage or mess. Another significant advantage of a fabric border is that the choice of fabric is not restricted to a limited range, as with paper borders, and it would be possible to select from the full range of fabric styles, colors and textures which are generally available.

A three dimensional border could be used to set the mood in a formal living room, dining room, master bedroom, etc. A border with a fabric or a combination of fabrics that contrast or match the other furnishings, perhaps with some upholstery trim, would provide instant charm, the decorating possibilities limited only by the decorator's imagination.

BRIEF SUMMARY OF THE INVENTION

In view of the above, it is an object of the present invention to provide a lightweight border that can be custom-made and used as a crown molding or chair rail. It is another object to provide a border that can be installed on a wall without damaging the wall and later removed without destroying the border. It is also an object to provide a border which can be used in college dorms or rented homes and apartments where pasting a wallpaper border would be prohibited thus allowing the resident to give his or her quarters a personal decorating touch. Other objects and features of the invention will be in part apparent and in part pointed out hereinafter.

In accordance with the invention, a three dimensional border for providing a decorative appearance as a crown molding or a chair rail has an elongated panel, preferably made of styrofoam, with a front face and rear face. A form is attached to the front face of the panel. The form has a surface upon which a decorative treatment can be applied. The rear face of the panel is adapted to be attached to a vertical wall by forming a recess in the panel as the rear face is pressed against nails or hooks provided on the wall. The border can be attached to the wall and removed without damaging wall or the border, such that the border can be used under circumstances where a wallpaper border pasted to the wall would be prohibited and the border can then be reused to reduce decorating costs.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
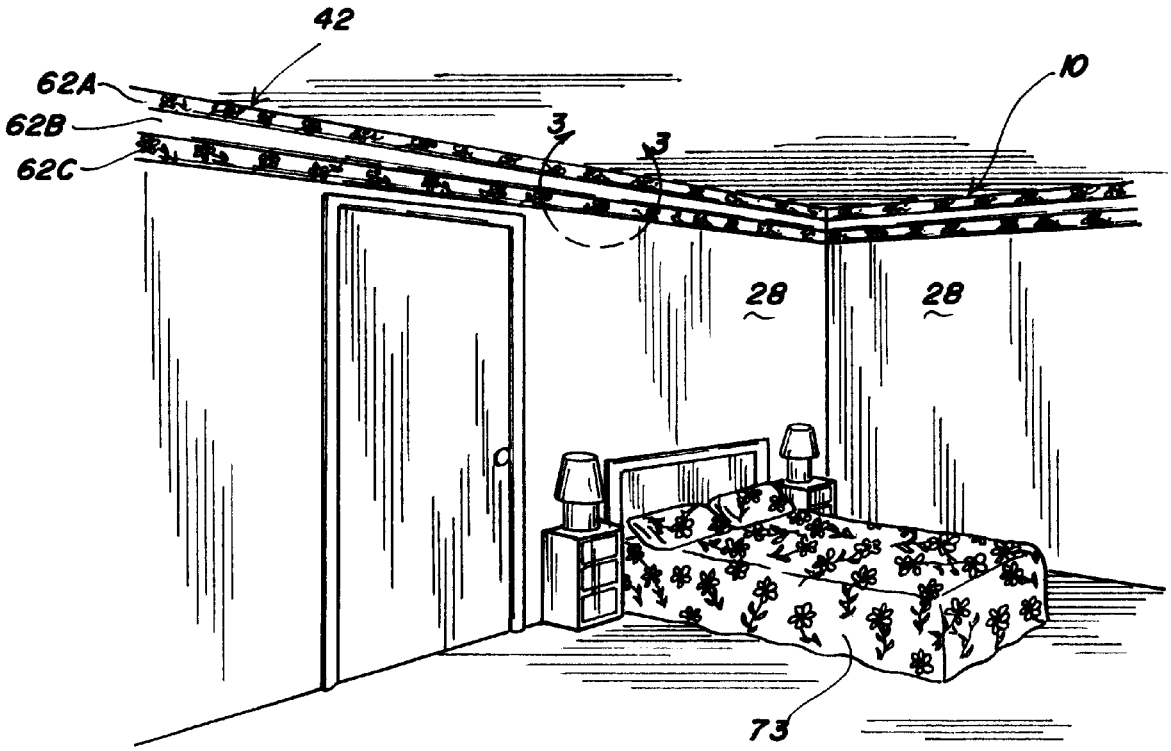
FIG. 1 is a perspective view of a border in accordance with the present invention installed as a crown molding.

Referring to the drawings more particularly by reference character, reference numeral 10 refers to a three dimensional border in accordance with the present invention. Border 10 includes an elongated panel 12 made from a lightweight, rigid but easily penetrated material such as cellular polystyrene sold under the trademark Styrofoam having a front face 14 and a rear face 16, top and bottom sides 18, 20 and right and left sides 22, 24, respectively. A form 26 upon which a decorative treatment can be applied, as more particularly described below, is attached to front face 14.

Border 10 provides an easy and inexpensive way to create a decorative crown molding or chair rail. As will become apparent, border 10 can be made by the purchaser at home, or by a designer in a retail/studio setting, or in a work room where it could be pre-wrapped as a style to be generally available and ordered when wanted. Border 10 is well adapted for storage, shipment and assembly in a modular or kit form. Elongated panel 12 and form 26 may be provided in standard lengths, with five-foot lengths being presently preferred. Border 10 may be offered in various widths such as 10", 15" and 18".

Figures 10A, 10B, 10C:
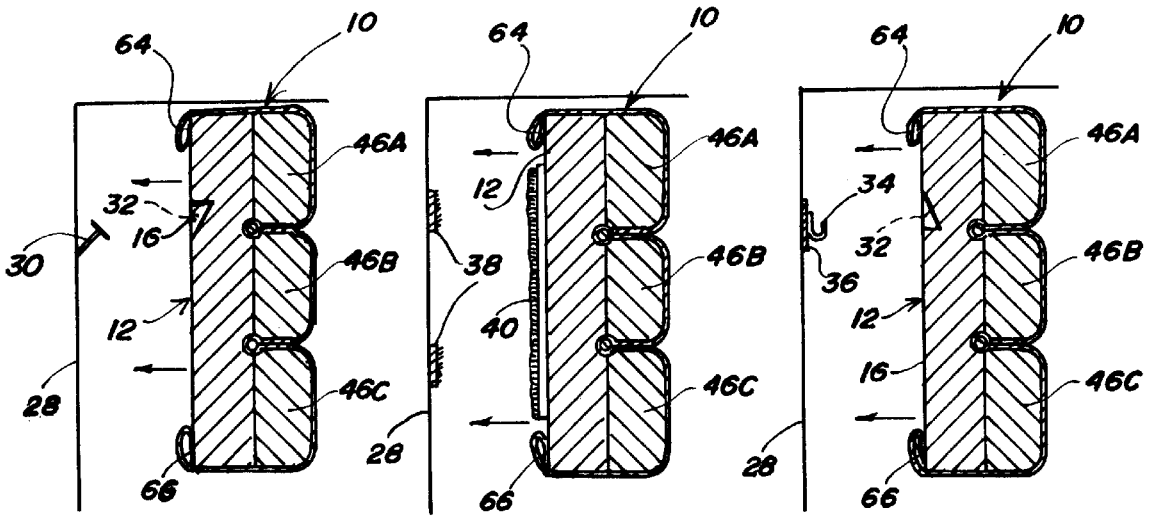
FIG. 10A is a side elevational view in cross section of a border illustrating a first non-destructive way of hanging the border on a wall.
FIG. 10B is a view similar to FIG. 10A showing a second non-destructive way to hang the border.
FIG. 10C is a view like FIG. 10A illustrating a third non-destructive way to hang the border.

Border 10 is intended to be a removable decoration for use by homeowners who do not want to damage their walls and by residents of rented quarters where permanent treatments are prohibited such as in college dorm rooms, apartments and the like. Border 10 can be applied as a crown molding or as a chair rail to a vertical wall 28 without damaging the wall and later removed from the wall without destroying the border, such that the border can be reused, saving on redecorating costs. For this reason, it is essential that elongated panel 12 be made from Styrofoam or the like. As illustrated in FIGS. 10A, 10B and 10C, various means can be used for the non-destructive attachment of border 10 to wall 28.

Referring first to FIG. 10A, a row of nails 30 may be set in wall 28. When elongated panel 12 is five-foot long, two or three nails 30 are sufficient in most instances, set at a spacing such that when rear face 16 of elongated panel 12 is pressed against the nails, a hollow recess 32 is formed in the Styrofoam by which border 10 is supported. Nails 30 are driven into wall 28 such that a major part of the shaft sticks out of the wall, with the shaft preferably angled upwardly. It takes no particular carpentry skills to set nails 30 as it is only necessary that they be within the perimeter and spaced across elongated panel 12 when border 10 is installed on wall 28. There are no alignment problems between recess 32 and nail 30, requiring careful measuring and carpentry skills, since the recess is formed as border 10 is installed. When border 10 is removed, nails 30 can be pulled and the holes filled with paint, or if required, spackling compound.

In FIG. 10C, a plurality of hooks 34 are provided at intervals on a tape 36. Tape 36 is attached to wall 28 with a contact adhesive. Hooks 34, like nails 30 in FIG. 10A, form a recess 32 as border 10 is installed on wall 28. Contact adhesive is selected so that tape 36 can be peeled from wall 28 without damaging it, when border 10 is removed. Hooks 34 may be spaced like nails 30, as described above, or may be more closely spaced, as desired.

A hook and pile fastener system, such as a VELCRO fastener system, is shown in FIG. 10B. With continuing reference to FIG. 10B, a pair of hook or pile fasteners of the same gender are shown attached to wall 28 as two parallel, horizontal strips 38. Vertical strips 40 of mating hook or pile fasteners are attached to rear face 16 of elongated panel 12, preferably near right and left sides 22, 24 thereof. When border 10 is pressed against wall, the fasteners engage. Horizontal strips 38 are attached to wall 28 with a contact adhesive, selected so that the strips can be peeled from wall 28 without damaging it, when border 10 is removed. Other methods for non-destructively attaching border 10 to wall 28 may occur to those skilled in the art, and should be understood as within the scope of the present invention.

Figure 2:
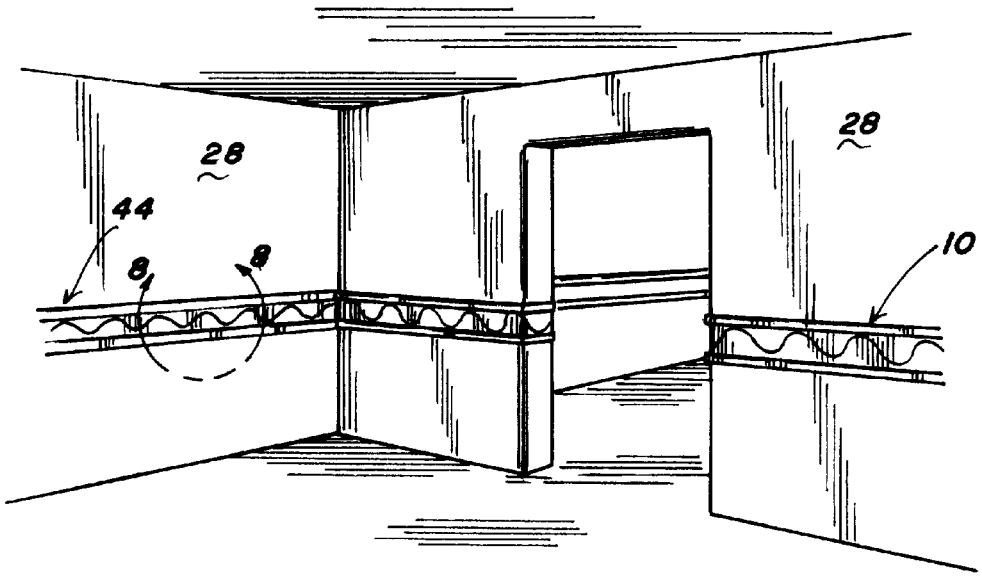
FIG. 2 is a perspective view of a second border in accordance with the present invention installed as a chair rail.
Figure 3:
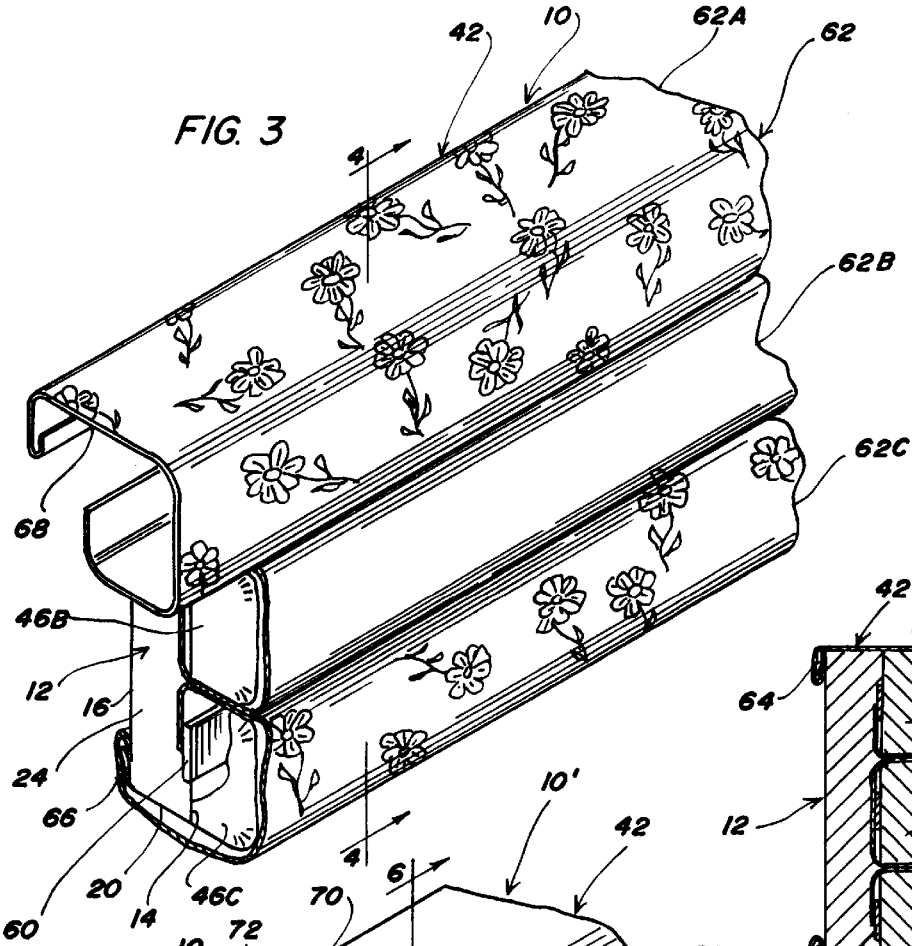
FIG. 3 is a detail, on an enlarged scale, taken along line 3—3 in FIG. 1.
Figure 4:
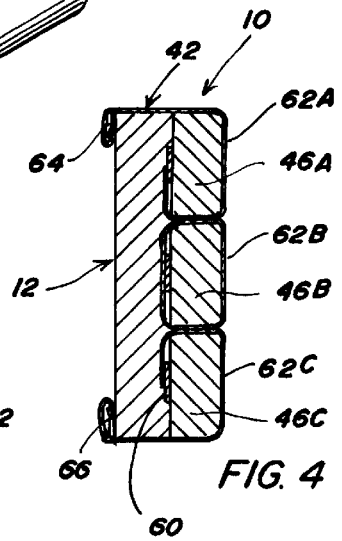
FIG. 4 is a cross-section taken along line 4—4 in FIG. 3.
Figure 7:
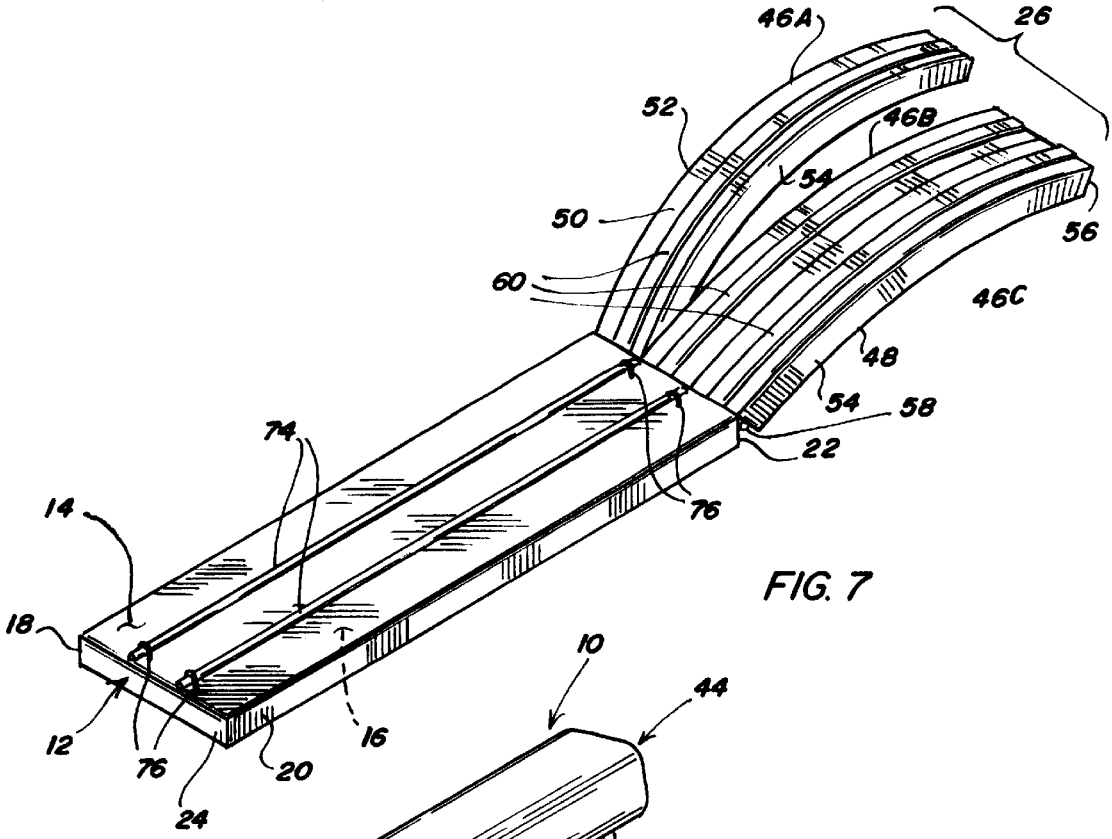
FIG. 7 is a perspective view of an elongated panel and a form for use in constructing the border shown in FIG. 5.

Turning to FIGS. 1 and 2, two embodiments of border 10 are illustrated, one in use as a crown molding 42 and the other as a chair rail 44. As shown in FIGS. 3–4, form 26 of crown molding 42 comprises three elongated members 46 (46A, 46B and 46C), illustrated as being equal in size. It will be understood, however, that there may be more or less than three members 46 and that the members may be of equal or unequal sizes. Members 46 are preferably padded for a softly molded look and, for example, may be made of a semi-soft foam, preferably cut to the length of elongated panel 12 as shown in FIG. 7. Members 46 have a front and a rear face 48, 50, top and bottom sides 52, 54 and right and left sides 56, 58, respectively, with a double sided adhesive tape 60 attached to rear face 50 for use in attaching a fabric 62. As shown in FIG. 1, fabric 62 is provided in three pieces 62A, 62B and 62C. Fabric piece 62A starts at rear face 16 of elongated panel 12, passes over top sides 18, 52 of panel 12 and member 46A, continues over front face and bottom side 48, 54 of member 46A and ends under rear face 50. At rear face 50 of elongated panel 46A, a margin of fabric piece 62A is tucked under a strip 64 of stiff material glued at the top of rear face 16, a free edge of which faces a free edge of another strip 66 of stiff material glued at the bottom of rear face 16. At front face 14, a margin of fabric piece 62A is adhered to double sided adhesive tape 60. The size of fabric piece 62A is arranged, such that it is stretched tight around member 46A with a short overhang 68 at one end (FIG. 3) and a longer overhang 70 at the other end (FIG. 5) for use in finishing right and left sides 22, 24 of elongated panel 12 as described below.

In similar manner a margin of fabric piece 62C is wrapped around bottom member 46C and is tucked under strip 66 at the bottom of rear face 16 and to double sided adhesive tape 60 under bottom member 46C. As will be readily understood from the drawings, fabric piece 62B is wrapped around middle member 46B, with opposite margins of which secured to double sided adhesive tape 60. A portion of double sided adhesive tape 60 not covered with fabric pieces 62A, 62B and 62C can be used to attach members 46 to front face 14 of elongated panel 12. Alternatively, two strips of double sided adhesive tape (not shown) can be attached at opposite ends and transverse a long axis of members 46 for attaching them to elongated panel 12.

Figure 5:
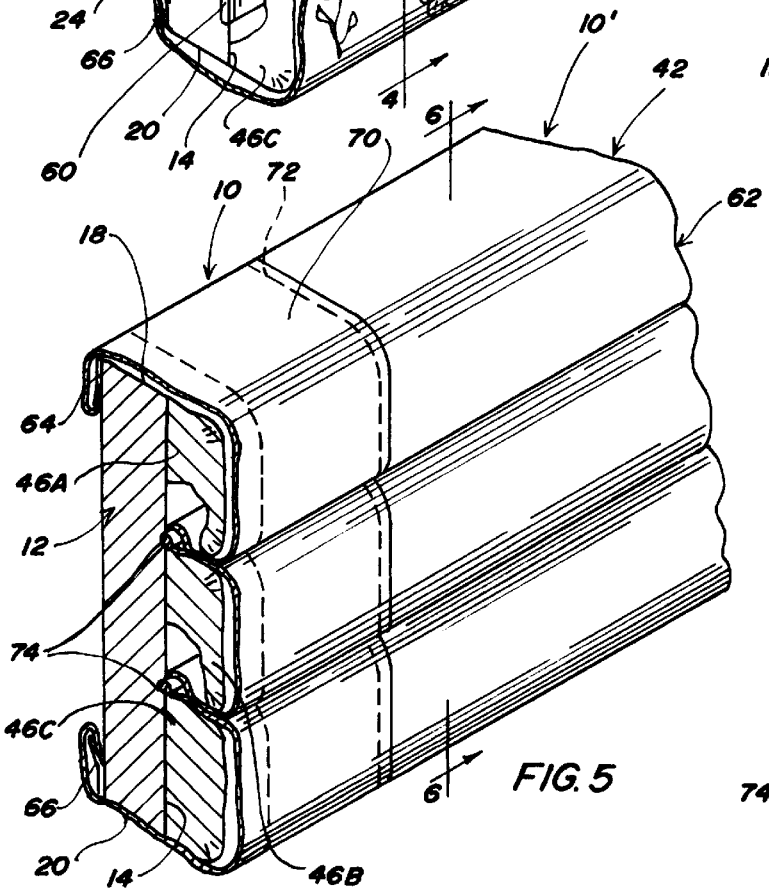
FIG. 5 is a perspective view of a third border in accordance with the present invention.

Right and left sides 22, 24 of elongated panel 12 can be finished as follows: Short overhang 68 of members 46 as shown with respect to member 46A in FIG. 3, is wrapped around left side 58 of top member 46A and left side 24 of elongated member 12 with the free margin of fabric piece 62A passing around to rear face 16 of elongated panel 12 where it is taped down or otherwise attached, as for example being trapped in a slit cut into the Styrofoam. A free edge of long overhang 70 as shown in FIG. 5 is turned under and finger pressed to form a hem 72, with the balance of the long overhang 70 forming a sleeve over adjoining member 46A, smoothly linking adjoining sections of border 10 and 10' end-to-end. As illustrated in FIGS. 1 and 3, fabric pieces 62A and 62C contrast with fabric piece 62B and match a bedspread 73. These drawings are intended as a "starter" idea from which the user can design his or her very own decorating scheme incorporating the colors or fabrics of sofas, chairs, cribs, etc., found in the room.

Figure 6:
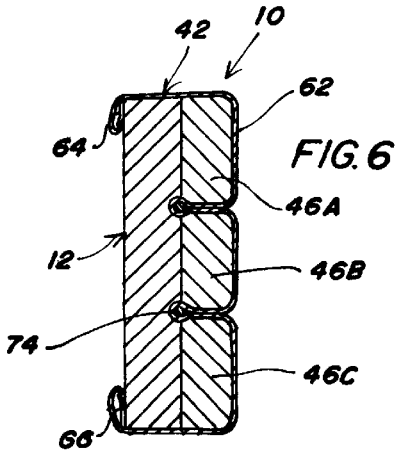
FIG. 6 is a cross section taken along line 6—6 in FIG. 5.

Sometimes, it is preferred that members 46 be covered with a continuous piece of fabric 62 as shown in FIGS. 5–6. In this instance, a number of clamping rods 74 are provided between adjacent members 46 for use as described below. As best seen in FIG. 7, clamping rods 74 are secured to front face 14 of elongated panel 12 by an appropriate fastener such as a open sided hook 76. As will become apparent, clamping rods 74 may be dowels, resilient fingers or the like. As illustrated in the drawings, a free margin of fabric 62 is tucked under strip 64 at the top of rear face 16, passes over member 46A, under the first clamping rod 74, over member 46B, under the second clamping rod 74, over member 46C and around its bottom side 54. At rear face 16 of elongated panel 12, a margin of fabric 62 is tucked under strip 66 at the bottom of the rear face. Short and long overhangs 68, 70 may be used for finishing and connecting adjoining sections of border 10.

Figure 8:
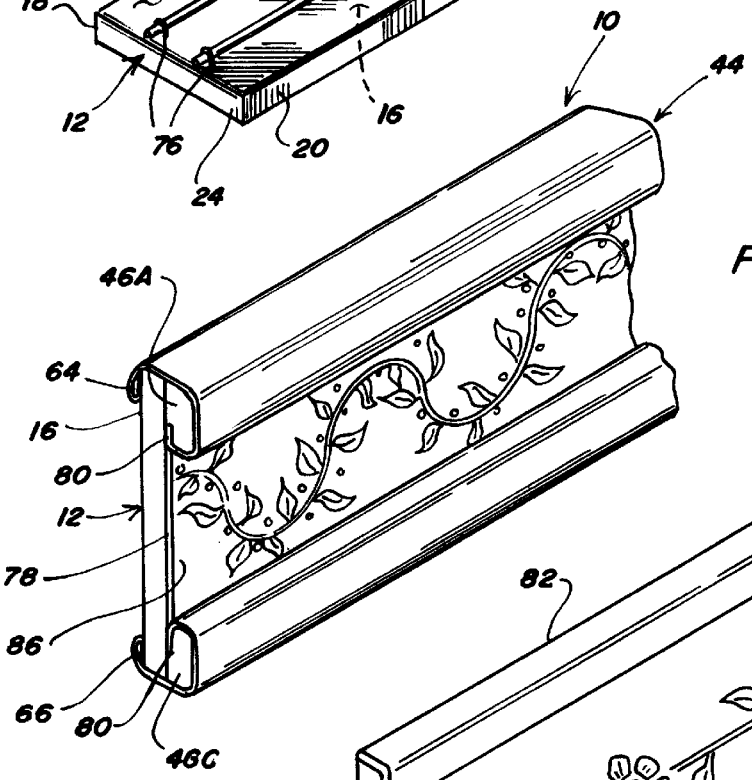
FIG. 8 is a detail, on an enlarged scale, taken along line 8—8 in FIG. 2.

As shown in FIG. 8, chair rail 44 comprises members 46A and 46C, flanking a flat panel 78 with a surface suitable for decorative treatment, e.g., painting or application of a wallpaper border. In the embodiment illustrated in the drawings, upper and lower portions, respectively, of members 46A and 46C are glued or otherwise secured to front face 14 of elongated panel 12, leaving opposing flaps 80 under which fabric pieces 62A and 62C are wedged. The other margins of fabric pieces 62A and 62C are secured in a manner similar to that described for the other embodiments. In this connection, it will be appreciated that glue (e.g., contact or hot glue) or double sided tape can be substituted for strips 64, 66, or elongated slits may be cut in Styrofoam into which the free margins of the fabric may be inserted. The presence of flat panel 78 obviously further opens up decorating possibilities, allowing for all sorts of wallpaper borders to be used with various fabrics to construct a multitude of possible three dimensional borders.

Figure 9:
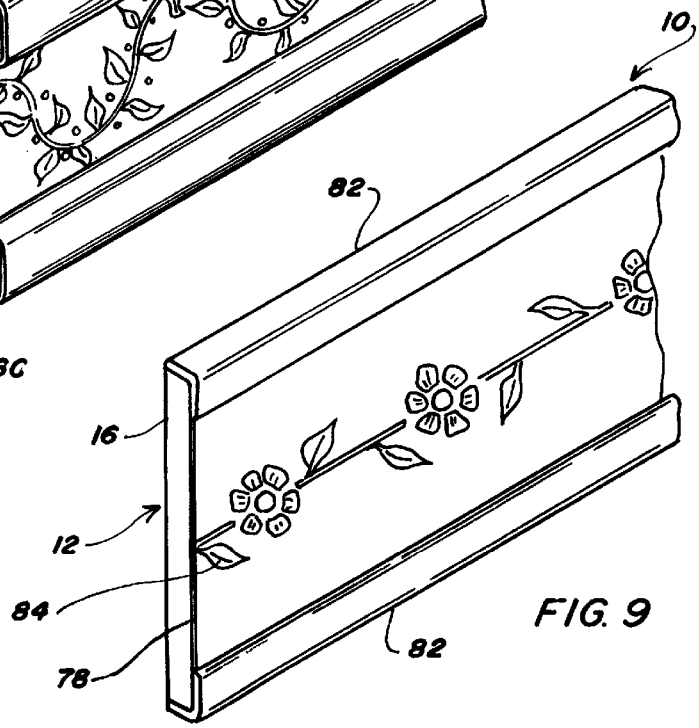
FIG. 9 is a perspective view of a fourth border in accordance with the present invention.

Another three dimensional border 10 is shown in FIG. 9, in which flat panel 78 is flanked, not with padded members 46A and 46C as shown in FIG. 8, but with L-shaped moldings 82 to be simply painted, or used to create an elegant look by gluing onto it fabric accents such as upholstery trim or cording, delicate lace, ribbon treatments etc. to frame and compliment the design chosen for the flat center section. Flat panel 82 can be stenciled with a design 84 or covered with a wallpaper border 86 as shown in FIG. 8. Other possible treatments include children's drawings, hand prints, etc.

Figure 11:
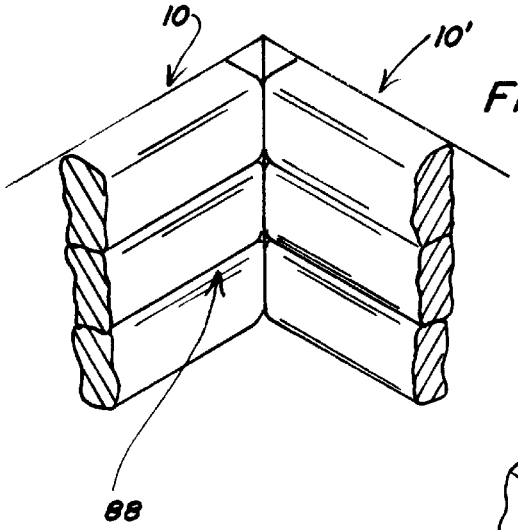
FIG. 11 is a perspective view of a border in accordance with the present invention forming an inside corner; and, FIG. 12 is a perspective view of the border forming an outside corner.
Figure 12:
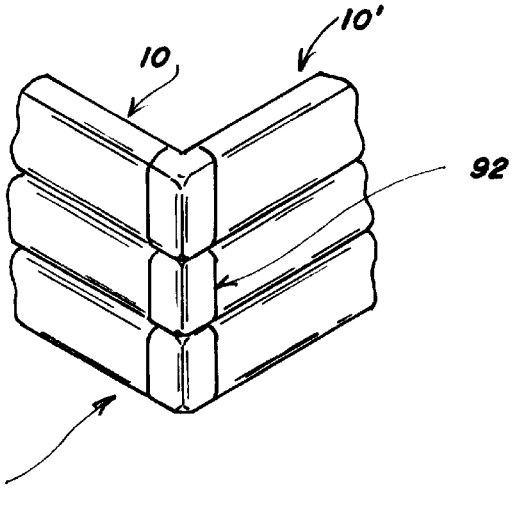

In use, sections of border 10 can be linked end-to-end as described above or butted together as shown in FIG. 11 to form an inside corner 88. An outside corner 90, as shown in FIG. 12, requires a filler strip 92, preferably contoured to match the profile of form 26.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A three dimensional border for providing a decorative appearance as a crown molding or chair rail comprising an elongated panel made from a lightweight, rigid cellular polystyrene, said panel having a front face and a rear face, a form attached to the front face of panel, said form having a surface upon which a decorative treatment can be applied, said rear face of the panel is easily penetrated and adapted to be attached to a vertical wall by forming a recess in the panel as the rear face is pressed against nails or hooks provided on the wall.

2. The border of claim 1 wherein the form comprises a flat panel flanked by strips of molding.

3. A three dimensional fabric border for providing a decorative appearance as a crown molding or chair rail, said border made in sections, each of which has an elongated panel made from a lightweight, rigid cellular polystyrene having a front face and a rear face, top, bottom, right and left sides, a form made from a flexible and soft material attached to the front face of the elongated panel, said form having a plurality of members about which one or more strips of fabric are wrapped, said fabric covering the sides of the elongated panel and secured to the back face of the elongated panel, said rear face of the panel is easily penetrated and adapted to be attached to a vertical wall by forming a recess in the panel as the rear face is pressed against nails or hooks provided on the wall.

4. The border of claim 2 wherein the one or more strips of fabric have a short overhang at one of the right or left sides of the elongated panel and a long overhang at the other of the right or left sides of the elongated panel, said short overhang finishing one end of the border and the long overhang forming a sleeve for linking adjacent sections.

5. The border of claim 4 wherein the members are side-by-side.

6. The border of claim 4 wherein the form further includes a flat panel with a surface suitable for a decorative treatment, flanked by the other members.

7. A three dimensional fabric border for providing a decorative appearance as a crown molding or chair rail, said border comprising sections, each of which has an elongated panel made from styrofoam having a front face and a rear face, top, bottom, right and left sides, a form made from a plurality of padded elongated members, said members being arranged side-by-side on the panel, clamping rods adapted to be attached to the front face of the panel, said clamping rods being between adjacent members, a strip of fabric secured at the top and bottom of the back face of the panel, said fabric passing over each of the members and under the clamping rods, fasteners for securing the clamping rods against the front face of the panel, said rear face of the panel adapted to be attached to a vertical wall by forming a recess in the panel as the rear face is pressed against nails or hooks provided on the wall.

8. The border of claim 7 wherein the strip of fabric has a short overhang at one end of the form and a long overhang at the other end of the form, said short overhang finishing one end of the border and the long overhang forming a sleeve for linking adjacent sections.

9. The border of claim 8 wherein the fabric is attached to the back face of the panel by tucking it under a pair of opposing stiff strips attached at the top and bottom of the back face.

* * * * *